US010995527B2

(12) United States Patent
Han

(10) Patent No.: US 10,995,527 B2
(45) **Date of Patent: *May 4, 2021**

(54) RETRACTABLE OUTSIDE DOOR HANDLE ASSEMBLY FOR VEHICLE

(71) Applicants: Hyundai Motor Company, Seoul (KR); Kia Motors Corporation, Seoul (KR)

(72) Inventor: Jungho Han, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 228 days.

This patent is subject to a terminal disclaimer.

(21) Appl. No.: 16/193,123

(22) Filed: Nov. 16, 2018

(65) Prior Publication Data

US 2019/0383066 A1 Dec. 19, 2019

(30) Foreign Application Priority Data

Jun. 15, 2018 (KR) ..... 10-2018-0068709

(51) Int. Cl.
*E05B 85/10* (2014.01)
*E05B 81/90* (2014.01)
(Continued)

(52) U.S. Cl.
CPC ..... *E05B 85/107* (2013.01); *E05B 81/90* (2013.01); *E05B 85/06* (2013.01); *E05B 85/103* (2013.01); *E05Y 2900/531* (2013.01)

(58) Field of Classification Search
CPC ..... E05B 85/107; E05B 85/103; E05B 81/90; E05B 85/06; E05B 79/22; E05B 85/10;
(Continued)

(56) References Cited

U.S. PATENT DOCUMENTS 8,807,807 B2 * 8/2014 Wheeler ..... E05B 1/0092 362/501
8,919,047 B2 * 12/2014 Johnsrud ..... E05B 85/107 49/503
(Continued)

FOREIGN PATENT DOCUMENTS

CN 102061833 A 5/2011
CN 103132874 A 6/2013
(Continued)

*Primary Examiner* — Lloyd A Gall
(74) *Attorney, Agent, or Firm* — Morgan, Lewis & Bockius LLP

(57) ABSTRACT

A retractable outside door handle assembly may include: an outside door handle protruded outward in a width direction of a vehicle rather than a door outer panel configuring a door of the vehicle or being receivable to an opening formed at the door outer panel; a first link having one end connected to one end of the outside door handle and the other end extending downward along a height direction of the vehicle; a second link having one end connected to one side and the other side of the outside door handle and the other end extending along the height direction of the vehicle; a main arm having one end rotatably connected to the door outer panel and the other end connected to the second link; and a moving block connected to the other end of the first link and the other end of the second link and movable upwards and downwards along the height direction of the vehicle.

14 Claims, 10 Drawing Sheets

(51) Int. Cl.
*E05B 85/06* (2014.01)
*E05B 79/22* (2014.01)

(58) Field of Classification Search
CPC . E05B 5/00; E05B 5/003; E05B 5/006; E05B 81/64; E05B 81/76; E05B 81/77; E05B 81/78; E05B 79/12; E05B 79/06; E05Y 2900/531; Y10S 292/31; Y10S 292/25
USPC ..... 70/208, 278.7, 279.1; 16/113.1, 405, 16/412, 414, 429; 292/336.3, 347, 292/DIG. 31, DIG. 63
See application file for complete search history.

(56) References Cited

U.S. PATENT DOCUMENTS 9,080,352 B2 * 7/2015 Aerts ..... E05B 85/18
9,103,143 B2 8/2015 Wheeler et al.
9,249,608 B2 * 2/2016 Lang ..... E05B 85/107
2008/0163555 A1 * 7/2008 Thomas ..... E05B 85/103 49/460
2010/0127516 A1 * 5/2010 Fannon ..... E05B 85/16 292/336.3
2013/0076048 A1 * 3/2013 Aerts ..... G07C 9/00944 292/336.3
2013/0127185 A1 * 5/2013 Lang ..... E05B 85/103 292/336.3
2013/0241215 A1 * 9/2013 Halliwell ..... E05B 85/107 292/336.3
2016/0222705 A1 * 8/2016 Velicanin ..... E05B 81/06
2016/0281397 A1 9/2016 Park et al.
2016/0298366 A1 10/2016 Och
2018/0058113 A1 3/2018 Han et al.
2019/0234122 A1 * 8/2019 Low ..... E05B 85/103
2020/0071973 A1 * 3/2020 Han ..... E05B 79/06

FOREIGN PATENT DOCUMENTS

CN 105507699 A 4/2016
CN 105637162 A 6/2016
DE 10 2016 112 689 A1 1/2018

* cited by examiner

RETRACTABLE OUTSIDE DOOR HANDLE ASSEMBLY FOR VEHICLE

CROSS-REFERENCE TO RELATED APPLICATION

The present application claims priority to Korean Patent Application No. 10-2018-0068709 filed on Jun. 15, 2018, the entire contents of which is incorporated herein for all purposes by this reference.

BACKGROUND OF THE INVENTION

Field of the Invention

The present invention relates to a retractable outside door handle assembly for a vehicle. More particularly, the present invention relates to a retractable outside door handle assembly for a vehicle, in which an outside door handle is received inside a door external panel or protrudes outside the door external panel.

Description of Related Art

In general, a vehicle has a predetermined size of cabin formed therein for boarding of a driver and accompanying occupants, and cabin opening/closing doors are provided for opening/closing the cabin.

For easily opening or closing the cabin opening/closing door by the passenger, an inside door handle is mounted on an inside surface toward a cabin internal to the door, and an outside door handle is mounted on an outside surface toward a cabin outside of the door.

Each door handle is connected to be interworked with a door latch to fix the door to a vehicle body, such that the door may be opened while the door latch is released according to an operation of each door handle.

The outside door handle is mounted to be pivotally movable to the external panel of the door, and in the instant case, the outside door handle is disposed on the door external panel to be protruded outside along a width direction of the vehicle so that the passenger may easily hold the outside door handle.

As above-described, if the outside door handle is disposed to be protruded outside along a width direction of the vehicle, operation convenience of the passenger is improved, however external beauty of the vehicle may be deteriorated due to the protruded outside door handle, also, a running noise may not be only caused in traveling of the vehicle, but also running performance may be also deteriorated due to running resistance.

Recently, to solve these problems, a retractable outside door handle, in which the outside door handle protrudes outside along the width direction of the vehicle from the door external panel or is received inside a receiving hole formed in the door external panel by the driving of an actuator (a motor) to not be protruded from the door external panel outside, has been developed.

The conventional retractable outside door handle assembly may have the outside door handle protrude from the door external panel via a link mechanism or may receive it inside the receiving hole of the door external panel through the actuator, and is connected to a door lock mechanism including a key cylinder configured for being operated for locking or releasing the door to the vehicle body and a door latch mechanism directly locking or releasing the door to/from the vehicle body.

However, in the structure of the conventional retractable outside door handle assembly, since the link mechanism retracting the outside door handle is configured for four-node links, to elongate a protruding length of the outside door handle for the operation convenience of the user, the length of the four-node links may be long, and accordingly, since the size of the handle housing may be increased, there are drawbacks that weight and cost are increased and the external beauty of the protruded outside door handle is also not satisfied.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing the retractable outside door handle assembly for the vehicle, in which a stroke of the outside handle may be made longer with a vertically short layout, a freedom degree of design may not only be improved but also operation reliability is also improved as the outside handle is linearly protruded and received, and a connectivity with other parts such as the door latch is improved, being widely used.

A retractable outside door handle assembly for a vehicle may include an outside door handle configured of being protruded outward in a width direction of a vehicle from a door external panel configuring a door of the vehicle or configured of being receivable to an opening formed at the door external panel; a first link having one end portion connected to one end portion of the outside door handle and the other end portion extending downward along a height direction of the vehicle; a second link having one end portion connected to a first side and a second side of the outside door handle and the other end portion extending along the height direction of the vehicle; a main arm having one end portion rotatably connected to the door external panel and the other end portion connected to the second link; and a moving block connected to the other end portion of the first link and the other end portion of the second link and movable upwards and downwards along the height direction of the vehicle.

An actuator pushing up above the moving block along the height direction of the vehicle may be further included.

The actuator may include: an actuator rod; and a plunger mounted at a leading end portion of the actuator rod and having a slanted surface, and a slanted surface corresponding to the slanted surface may be formed under the moving block.

The second link may include: a first link arm and a second link arm disposed to be separated back and forth along a longitudinal direction of the vehicle and each having one end portion connected to the outside door handle; and a connection arm connecting the other end portion of the first link arm and the other end portion of the second link arm.

The first pin axis may be configured to be protruded from both side surfaces of the moving block, and the other end portion of the first link is inserted into the first pin axis to be rotatably supported.

The second pin axis may be configured to be protruded from both side surfaces of the moving block, a boss may be provided at the connection arm, and the second pin axis may be inserted to penetrate the boss so that the second link is rotatably supported via the second pin axis.

The first pin axis and the second pin axis may be connected to each other through a connecting member.

The outside door handle may include: a handle housing; a holding hole formed at an upper surface of the handle housing; a boss formed inside the handle housing, to which a pin axis for rotatably engaging one end portion of each of the first link arm and the second link arm is coupled; and a boss to which a pin axis for rotatably engaging one end portion of the first link is coupled.

One end portion of the main arm may be rotatably connected to the second link through the pin axis, and the other end portion of the main arm may be mounted at the door external panel to be rotatable.

A return spring may be disposed between the main arm and the second link.

A guide groove may be formed under the moving block, and a guide pin inserted into the guide groove to guide the moving block may be further provided.

One side of the emergency lever may be disposed at one side of the outside door handle to be rotatable, and the other side of the emergency lever may be configured to be rotatable with respect to the supporting point.

A key cylinder may be further included, and the key cylinder may form the supporting point of the emergency lever.

According to the retractable outside door handle assembly for the vehicle according to an exemplary embodiment of the present invention, a stroke of the outside handle may be made longer with a vertically short layout such that connectivity of a door latch may be improved.

Also, since the outside handle is linearly protruded and received, a freedom degree of design may be improved.

In additional, an operation reliability of the outside handle may be improved, a rigidity may be increased, and a connectivity with other parts such as the door latch is improved, being widely used and reducing a weight and a cost.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
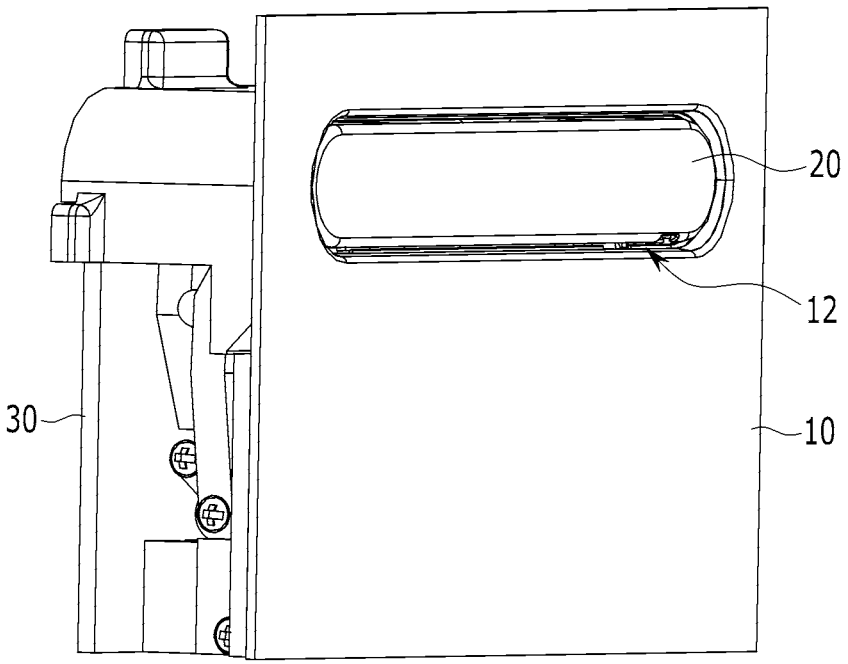
FIG. 1 is a perspective view of a state in which a retractable outside door handle assembly for a vehicle according to an exemplary embodiment of the present invention is mounted on a door external panel.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, an exemplary embodiment of the present invention will be described in detail with reference to the accompanying drawings.

Referring to FIG. 1, the retractable outside door handle assembly for the vehicle according to an exemplary embodiment of the present invention may include an outside door handle 20 that protrudes outside in a width direction of a vehicle from a door external panel 10 through an opening 12 formed on a door external panel 10 or is received in the opening 12 to form almost the same plane as an outside surface of the door external panel 10.

The outside door handle 20 may be configured to be movable in the width direction of the vehicle to a base plate 30 disposed inward in a width direction of the vehicle rather than the door external panel 10 and mounted at the door external panel 10 to be fixed.

Figure 2:
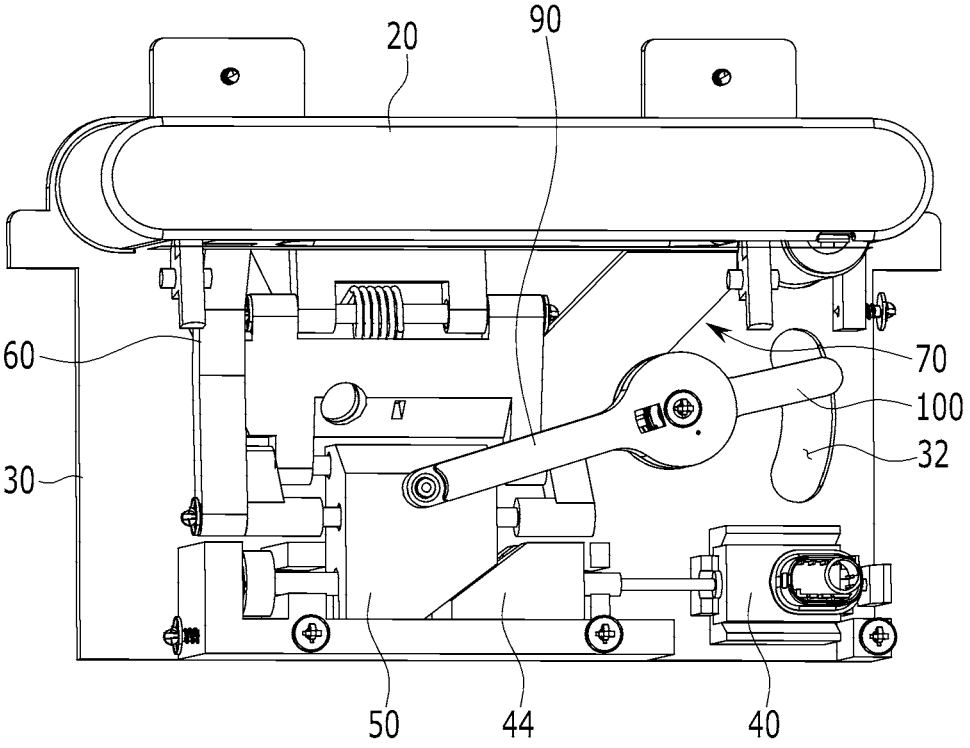
FIG. 2 is a front view of a retractable outside door handle assembly for a vehicle according to an exemplary embodiment of the present invention.
Figure 3:
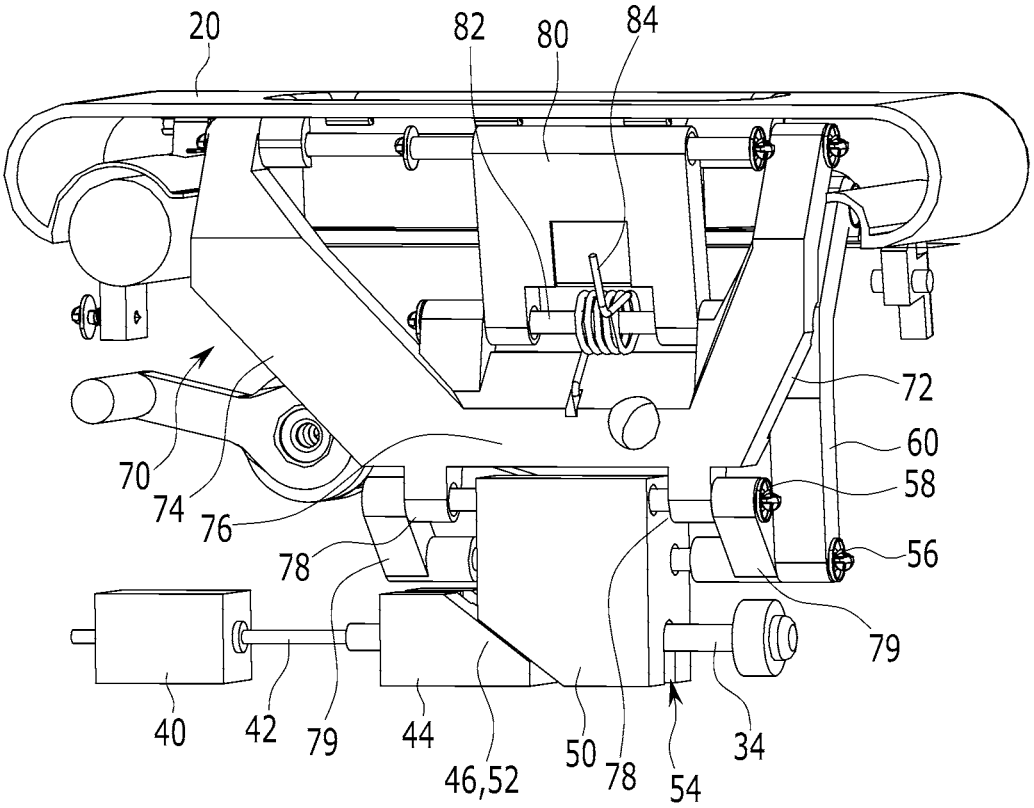
FIG. 3 is a perspective view of a retractable outside door handle assembly for a vehicle according to an exemplary embodiment of the present invention.

Referring to FIG. 2 and FIG. 3, the retractable outside door handle assembly for the vehicle according to an exemplary embodiment of the present invention may further include an actuator 40 which is movable back and forth along the longitudinal direction of the vehicle by receiving an electrical signal, and a moving block 50 moving upwards and downwards along a height direction of the vehicle by the actuator.

The actuator 40 may include an actuator rod 42 and a plunger 44 mounted at the leading end portion of the actuator rod 42, and the plunger 44 may provide a slanted surface 46 of which one corner is cut to be slanted while having a polygonal block shape.

A slanted surface 52 corresponding to the slanted surface 46 may also be provided with the shape of which one corner is cut under the moving block 50.

First and second pin axes 56 and 58 are configured to be protruded from both surfaces of the moving block 50, and one end portion of a first link 60 may be inserted to the first pin axis 56 to be rotatably supported.

A second link 70 includes a first link arm 72 and a second link arm 74 disposed to be separated back and forth along the longitudinal direction of the vehicle and a connection arm 76 connecting one end portion of each of the first link arm 72 and the second link arm 74, substantially having a "U" shape, two bosses 78 are provided in the connection arm 76, and the second pin axis 58 is inserted after passing through the two bosses 78, the second link 70 may also be rotatably supported through the second pin axis 58.

Also, the first pin axis 56 and the second pin axis 58 may be connected to each other through a connecting member 79.

The other end portion of the first link 60 and the other end portion of each of the first link arm 72 and the second link arm 74 of the second link 70 may be rotatably connected to the outside door handle 20 through the pin axis.

Accordingly, the moving of the first and second links 60 and 70 is transmitted to the outside door handle 20 such that the first and second links 60 and 70 and the outside door handle 20 are linked.

Figure 4:
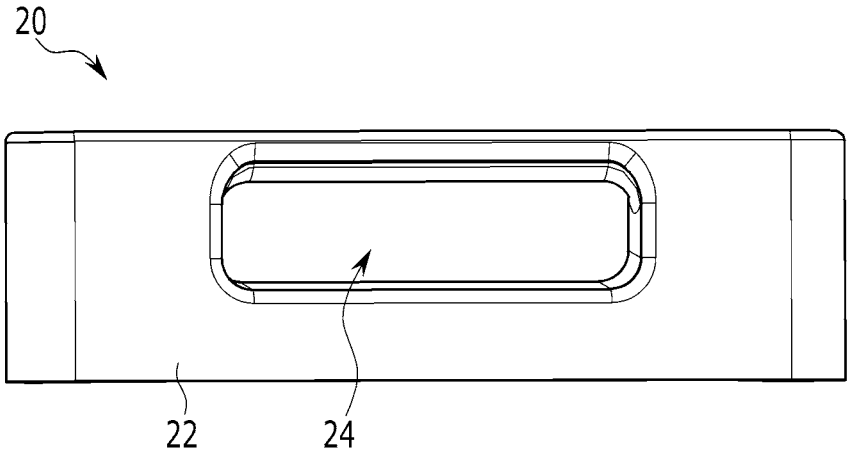
FIG. 4 is a top plan view of an outside door handle according to an exemplary embodiment of the present invention.
Figure 5:
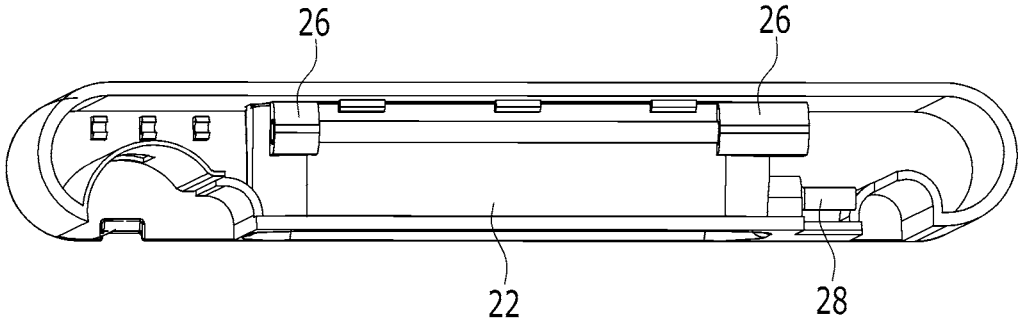
FIG. 5 is a rear view of an outside door handle according to an exemplary embodiment of the present invention.

Referring to FIG. 4 and FIG. 5, the outside door handle 20 may integrally include a handle housing 22, a holding hole 24 formed at the upper surface of the handle housing 22 and configured for receiving a hand of the user for holding the handle housing 22, two bosses 26 to which the pin axis for rotatably engaging the other end portion of each of the first link arm 72 and the second link arm 74 to the internal to the handle housing 22 is coupled, and a boss 28 to which the pin axis for rotatably engaging the other end portion of the first link 60 is coupled.

Again referring to FIG. 3, one end portion of a main arm 80 is rotatably connected to the second link 70 through a pin axis 82 and the other end portion of the main arm 80 is rotatably mounted at the door external panel 10, and a return spring 84 is disposed between the main arm 80 and the second link 70.

Accordingly, the rotation movement of the second link 70 is limited by the door external panel 10 through the main arm 80.

Again referring to FIG. 2, one end portion of a connecter link 90 is engaged to the moving block 50, the other end portion of the connecter link 90 is connected to a connecter rod 100, and the other end portion of the connecter rod 100 is inserted into a guide hole 32 with a circular arc shape formed at the base plate 30, being moved along the guide hole 32.

The connecter rod 100 is connected to a door latch through a cable, etc., and if the connecter rod 100 is rotated, the door latch may be opened.

Figure 6:
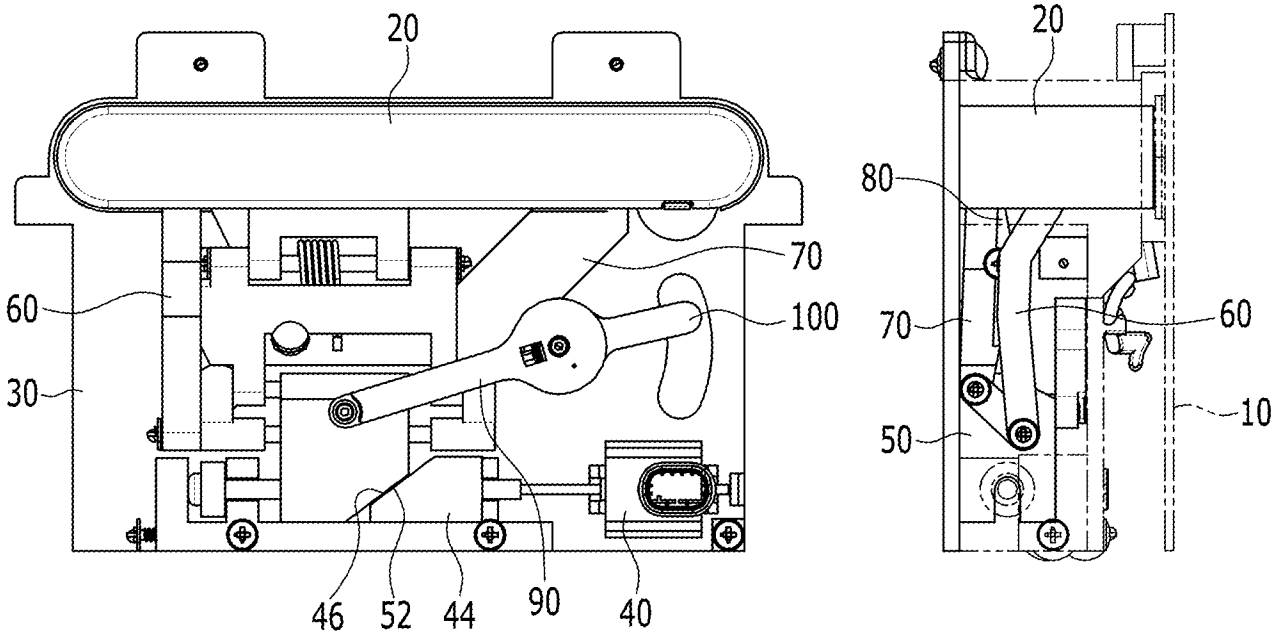
FIG. 6, FIG. 7 and FIG. 8 are schematic diagrams describing an operation of a retractable outside door handle assembly for a vehicle according to an exemplary embodiment of the present invention.
Figure 7:
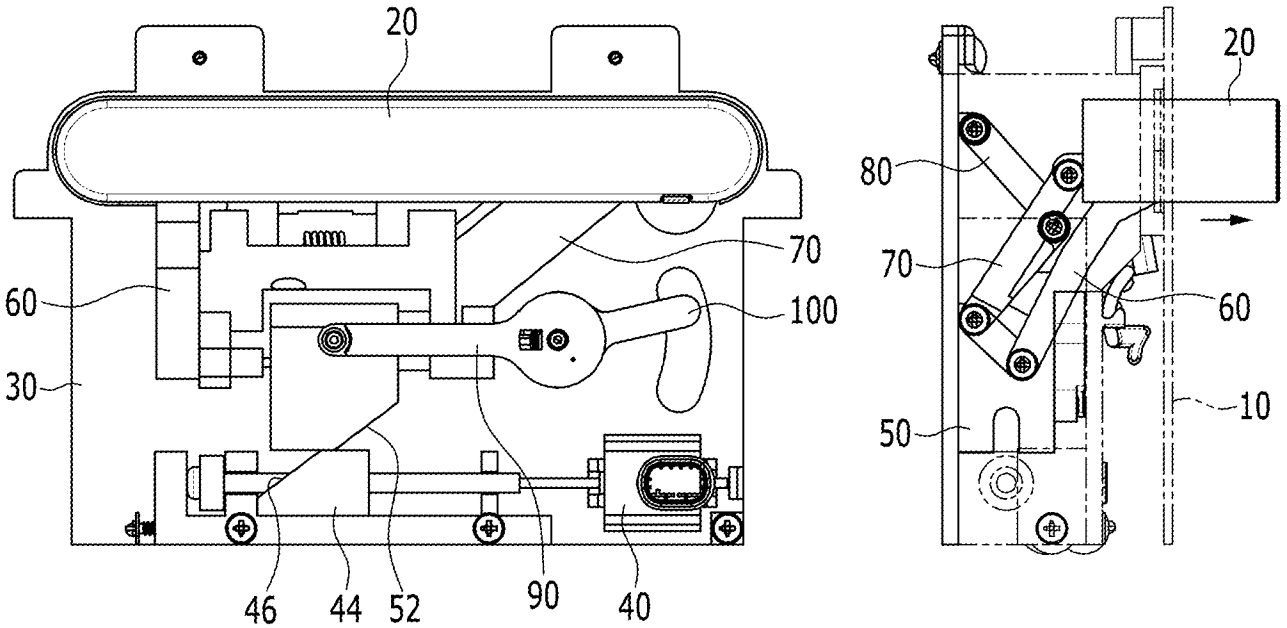
Figure 8:
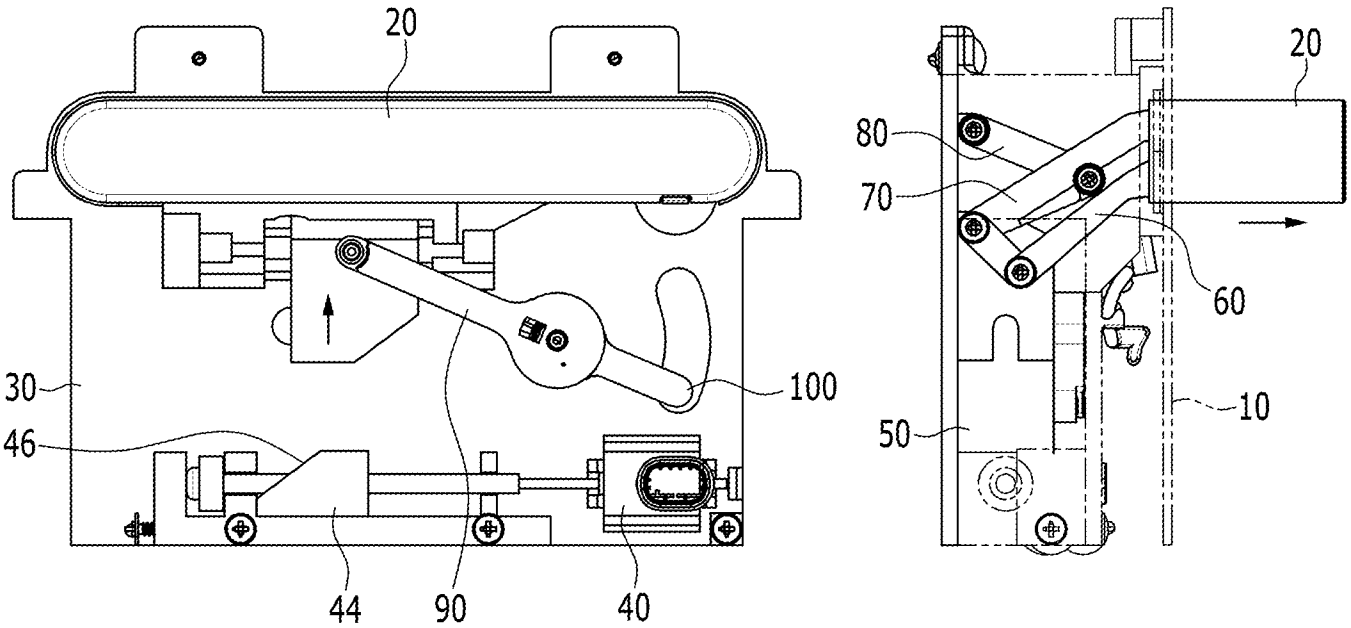

Referring to FIG. 6, FIG. 7, and FIG. 8, FIG. 6 shows a state in which the outside door handle 20 is received inside the opening 12 of the door external panel 10. That is, the state in which the door is closed is shown.

When the driver approaches the vehicle such that the actuator 40 receives the operational signal thereof, as shown in FIG. 7, as the plunger 44 moves forward along the longitudinal direction of the vehicle, the moving block 50 is pushed up in the height direction of the vehicle by the mutual operation of the slanted surface 46 of the plunger 44 and the slanted surface 52 of the moving block 50.

Also, the first link 60 and second link 70 connected to the moving block 50 rise together as the moving block 50 rises. If the first link 60 and the second link 70 rise, since the second link 70 is rotatably connected to the main arm 80 by the pin and the main arm 80 is rotatably connected to the door external panel 10, as the second link 70 rotatably moves outward in the width direction of the vehicle, and simultaneously the first link 60 also rotatably moves outward in the width direction of the vehicle, the outside door handle 20 connected to the first link 60 and the second link 70 protrudes outward in the width direction of the vehicle rather than the door external panel 10.

In the present process, the connecter link 90 connected to the moving block 50 is rotated in a clockwise direction thereof, however the rotation movement of the connecter link 90 is not transmitted to the connecter rod 100 such that the connecter rod 100 is not rotated.

In the state in which the moving block 50 climbs on the upper surface of the plunger 44 such that the raising of the moving block 50 by the plunger 44 is completed, that is, the outside door handle 20 protrudes outside the door external panel 10, when the user puts a hand into the holding hole 24 of the outside door handle 20 and pulls the outside door handle 20 outward in the width direction of the vehicle, as shown in FIG. 8, the outside door handle 20 is pulled outward in the width direction of the vehicle and the first and second links 60 and 70 are also rotatably moved in the clockwise direction thereof, and the moving block 50 also further rises.

In the present process, as the connecter link 90 is also rotated in the clockwise direction and the rotation movement of the connecter link 90 is transmitted to the connecter rod 100, the connecter rod 100 moves along the guide hole 32 formed in the base plate 30 to release the door latch connected to the connecter rod 100, the door is opened.

On the other hand, after the door is opened according to the operation of the connecter rod 100, if the user releases the outside door handle 20, the main arm 80 is rotated to its original position by the elastic restoring force of the return spring 84, the outside door handle 20 is inserted inside the opening 12 of the door external panel 10 by the rotation of the main arm 80, and the moving block 50 is lowered to the initial position.

In the raising and lowering process of the moving block 50, for smooth raising and correct original position restoration of the moving block 50, as shown in FIG. 2 and FIG. 3, a guide groove 54 of a shape which is recessed inside the moving block 50 is formed under the moving block 50, and a guide pin 34 inserted into the guide groove 54 is disposed at the base plate 30.

That is, in the rising and falling process of the moving block 50, the guide groove 54 of the moving block 50 is inserted to the guide pin 34, guiding the movement of the moving block 50.

Figure 9:
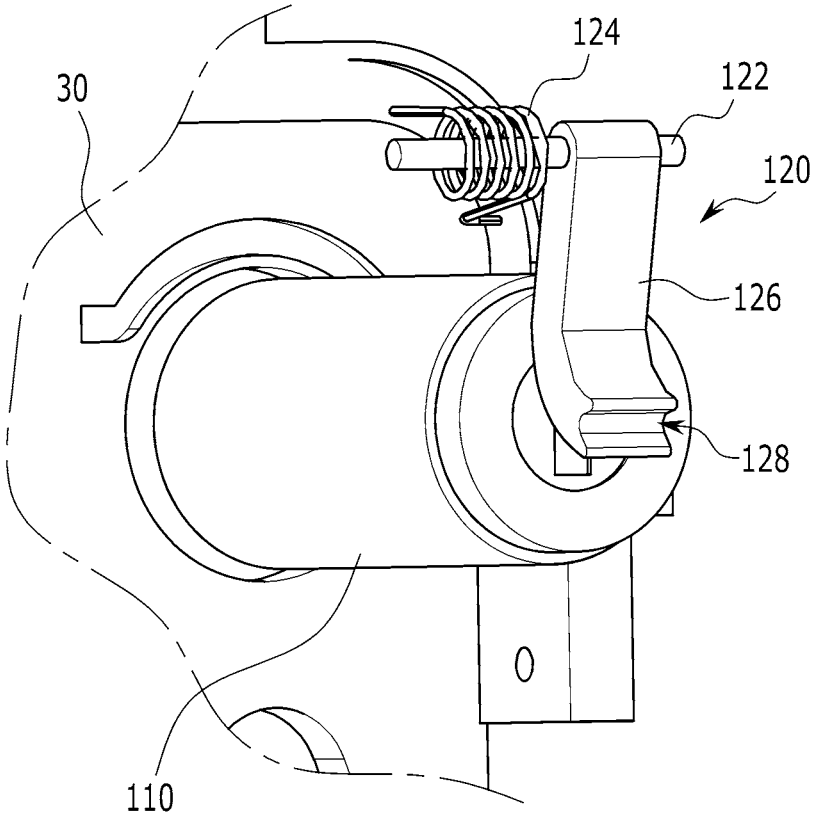
FIG. 9 is a perspective view of an emergency lever according to an exemplary embodiment of the present invention.

Referring to FIG. 9, when a smart key of the vehicle or the actuator 40 is not operated, to open the door by the key of the general vehicle, a key cylinder 110 may be mounted at the base plate 30.

Also, if the actuator 40 is inoperative, when it is not possible to protrude the outside door handle 20 via the actuator 40, an emergency lever 120 may be further provided so that the user of the vehicle may manually protrude the outside door handle 20.

The emergency lever 120 is disposed at the outside door handle 20 to be rotatable via its hinge axis 122, and a return spring 124 may be disposed with a rewinding shape for returning the emergency lever 120 to the original position at the hinge axis 122 after the operation of the emergency lever 120.

The emergency lever 120 may include a lever body 126 which is substantially bent with an obtuse angle and a tool groove 128 formed at one end portion of the lever body 126, and the hinge axis 122 is inserted to be penetrated at the other end portion of the lever body 126.

When the emergency lever 120 is disposed to approach the key cylinder 110 and the emergency lever 120 is rotated with respect to its hinge axis 122, a portion of the key cylinder 110 may function as a supporting point of the lever body 126.

Figure 10:
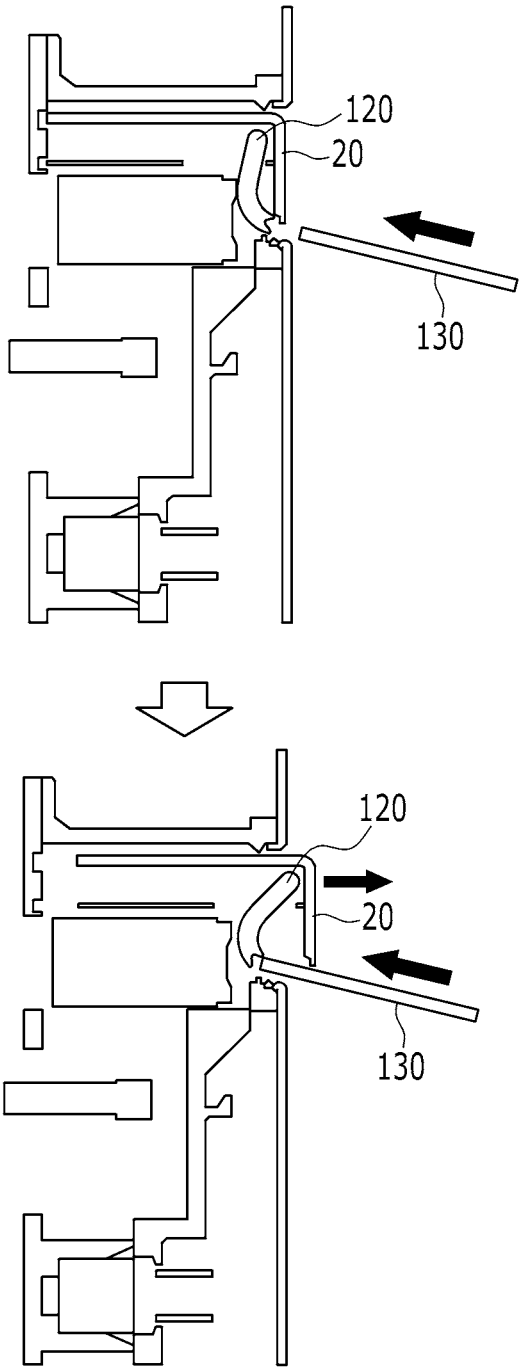
FIG. 10 is a cross-sectional view describing an operation of an emergency lever according to an exemplary embodiment of the present invention.

That is, as shown in FIG. 10, when the vehicle user cannot open the door for the reason described above, if a tool 130 such as a rod having a thin thickness is inserted into a gap between the opening 12 and the outside door handle 20 to push the emergency lever 120, part of the emergency lever 120 is in contact with the key cylinder 110 to rotate the emergency lever 120 in the clockwise direction via the supporting point, and accordingly, as one side of the outside door handle 20 is pushed outward in the width direction of the vehicle by the emergency lever 120 to be slightly protruded from the opening 12, the vehicle user holds the protruded outside door handle 20 to be pulled outward in the width direction of the vehicle, opening the door.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A retractable outside door handle assembly for a vehicle, the retractable outside door handle assembly comprising:

an outside door handle configured of being protruded outward in a width direction of the vehicle from a door external panel configuring a door of the vehicle or configured of being receivable to an opening formed at the door external panel;

a first link having a first end portion connected to an end portion of the outside door handle and a second end portion extending downward along a height direction of the vehicle;

a second link having a first end portion connected to a first side and a second side of the outside door handle and a second end portion extending along the height direction of the vehicle;

a main arm having a first end portion rotatably connected to the door external panel and a second end portion rotatably connected to the second link; and a moving block connected to the second end portion of the first link and the second end portion of the second link and configured for being movable upwards and downwards along the height direction of the vehicle.

2. The retractable outside door handle assembly for the vehicle of claim 1, further including:

an actuator assembly engaged to the moving block and configured for selectively pushing the moving block along the height direction of the vehicle.

3. The retractable outside door handle assembly for the vehicle of claim 2, wherein the actuator assembly includes:

an actuator;

an actuator rod connected to the actuator; and a plunger mounted at an end portion of the actuator rod and having a first slanted surface facing with a second slanted surface of the moving block.

4. The retractable outside door handle assembly for the vehicle of claim 1, wherein the second link includes:

a first link arm and a second link arm mounted to be separated back and forth thereof along a longitudinal direction of the vehicle and each having a first end portion connected to the outside door handle; and a connection arm connecting a second end portion of the first link arm and a second end portion of the second link arm.

5. The retractable outside door handle assembly for the vehicle of claim 4, wherein a first pin axis is configured to be protruded from a first side surface and a second side surface of the moving block, and wherein the second end portion of the first link is inserted into the first pin axis to be rotatably supported by the first pin axis.

6. The retractable outside door handle assembly for the vehicle of claim 5, wherein a second pin axis is configured to be protruded from the first side surface and the second side surface of the moving block;

wherein a boss is provided at the connection arm; and wherein the second pin axis is inserted to penetrate the boss so that the second link is rotatably supported via the second pin axis.

7. The retractable outside door handle assembly for the vehicle of claim 6, wherein the first pin axis and the second pin axis are connected to each other through a connecting member.

8. The retractable outside door handle assembly for the vehicle of claim 4, wherein the outside door handle includes:

a handle housing;

a holding hole formed at an upper surface of the handle housing;

a first boss formed inside the handle housing, to which a first pin axis for rotatably engaging the first end portion of each of the first link arm and the second link arm is coupled; and a second boss to which a second pin axis for rotatably engaging the first end portion of the first link is coupled.

9. The retractable outside door handle assembly for the vehicle of claim 8, wherein the second end portion of the main arm is rotatably connected to the second link through a third pin axis, and wherein the first end portion of the main arm is mounted at the door external panel to be rotatable.

10. The retractable outside door handle assembly for the vehicle of claim 8, wherein an elastic member is mounted between the main arm and the second link.

11. The retractable outside door handle assembly for the vehicle of claim 1, wherein a guide groove is formed at a lower portion of the moving block, and wherein a guide pin inserted into the guide groove to guide the moving block is mounted at a base plate.

12. The retractable outside door handle assembly for the vehicle of claim 1, wherein a first side of an emergency lever is mounted at a side of the outside door handle to be rotatable, and wherein a second side of the emergency lever is rotatable with respect to a supporting point.

13. The retractable outside door handle assembly for the vehicle of claim 12, further including:

wherein a portion of a key cylinder forms the supporting point to support the emergency lever.

14. The retractable outside door handle assembly for the vehicle of claim 1, further including:

a connecter link pivotally connected to a base plate, wherein a first end of the connecter link is engaged to the moving block, a second end of the connecter link is connected to a first end of a connecter rod, and a second end of the connecter rod is inserted into a guide hole formed at the base plate.

* * * * *